United States Patent [19]

Hasebe et al.

[11] Patent Number: 4,741,716

[45] Date of Patent: May 3, 1988

[54] MOORING SYSTEM

[75] Inventors: Hiroshi Hasebe, Saitama; Masanori Kajiwara; Hiroshi Hiramoto, both of Nagareyama; Hiroya Oka, Matsudo, all of Japan

[73] Assignee: Mitsui Ocean Development & Engineering Co., Ltd., Tokyo, Japan

[21] Appl. No.: 50,050

[22] Filed: May 13, 1987

[30] Foreign Application Priority Data

Feb. 12, 1987 [JP] Japan ..... 62-27996

[51] Int. Cl.[4] ..... B63B 22/02

[52] U.S. Cl. ..... 441/4; 441/3; 114/230; 141/387; 294/82.27

[58] Field of Search ..... 114/210, 200, 230, 293, 114/377, 378, 379, 380; 441/3, 4, 5; 141/387; 294/82.27, 19.1, 114

[56] References Cited

U.S. PATENT DOCUMENTS

| | | | |
|---|---|---|---|
| 2,818,297 | 12/1957 | Cook | 294/82.27 |
| 3,661,416 | 5/1972 | Bukarkin et al. | 114/378 |
| 4,085,781 | 4/1978 | Serpas et al. | 141/387 |
| 4,182,389 | 1/1980 | Guillaume et al. | 141/387 |
| 4,281,611 | 8/1981 | Vilain | 441/5 |
| 4,459,930 | 7/1984 | Flory | 441/5 |
| 4,490,121 | 12/1984 | Coppens et al. | 114/230 |
| 4,604,961 | 8/1986 | Ortloff et al. | 441/4 |
| 4,645,467 | 2/1987 | Pollack | 441/4 |
| 4,650,431 | 3/1987 | Kentosh | 441/4 |

*Primary Examiner*—Joseph F. Peters, Jr.
*Assistant Examiner*—Thomas J. Brahan
*Attorney, Agent, or Firm*—Bierman & Muserlian

[57] ABSTRACT

A mooring system for a tanker comprising an outrigger secured to the tanker, a buoy anchored by chains, and a buoy supporting structure mounted in the outrigger, the buoy supporting structure being connected to or disconnected from the buoy.

3 Claims, 3 Drawing Sheets

MOORING SYSTEM

FIELD OF THE INVENTION

This invention relates to a mooring system for a buoyant structure or vessel having a storage capacity of an enormous quantity of fluid, such as a tanker. More particularly the present invention relates to a single-point mooring system which can be connected to or disconnected from the tanker, if desired.

BACKGROUND OF THE INVENTION

Heretofore, the practice utilized to transfer the fluid from offshore fluid well installations to the tanker which is generally permanently secured to one mooring buoy positioned in the vicinity of offshore installations.

This system has many inherent disadvantages. For example, the securing of the tanker to the buoy is hazardous, particularly in hostile environment conditions, such as for example, in the condition of stormy weather, or in the condition that ice is drifted into the tanker or the water surrounding the tanker is frozen into ice.

In order to release the tanker moored with the buoy therefrom in heavy weather or in ice drift conditions to make the tanker safe, U.S. Pat. No. 4,490,121 discloses a mooring system in which a buoy can be connected to or disconnected from an arm attached to a tanker and being of conical shape and having a circumferentially extending groove for the engagement of a quick connecting coupling comprising releasable locking means carried by the arm, the buoy with its conical outer face fitting into a corresponding recess of the arm and being held up out of the water by the arm when coupled to the arm and floating on the water surface when uncoupled from the arm.

OBJECTS OF THE INVENTION

It is a main object of the present invention to provide a mooring system in which the tanker can easily be connected to or disconnected from the buoy.

It is a further object of the present invention to provide a mooring system which is mechanically simple and is readily adaptable for inspection.

BRIEF DESCRIPTION OF THE DRAWINGS

Other features and advantages of the invention will be apparent from the following description taken in connection with the accompanying drawings, wherein.

DESCRIPTION OF THE PREFERRED EMBODIMENT

Figure 1:
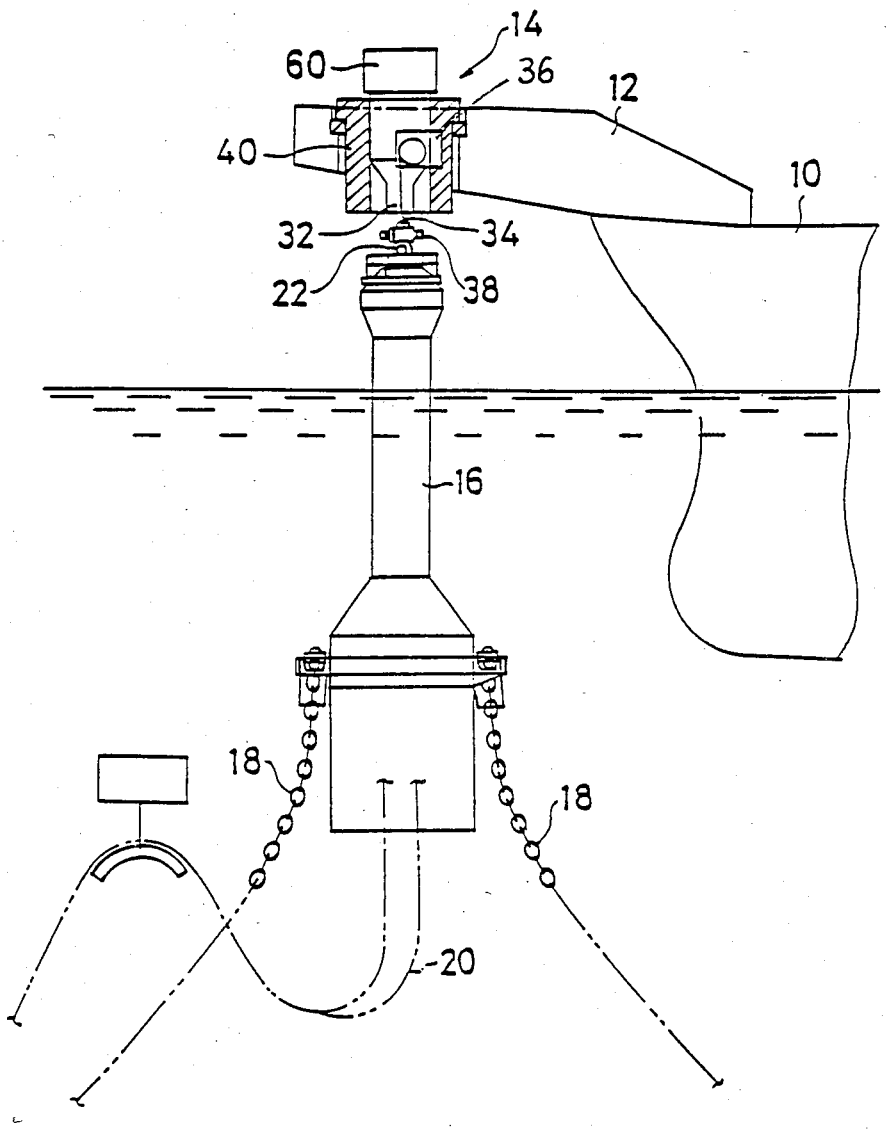
FIG. 1 illustrates schematically a side elevation of a connection between a tanker and a buoy according to the present invention.

Referring now more in detail to the drawings, a vessel 10, such as a tanker, is provided with a stiff forward extending cantilever arm or outrigger 12. A buoy supporting structure 14 is mounted on the forward end of the outrigger 12 so as to rotate about a vertical axis.

A buoy 16 can moor the tanker 10 when the buoy 16 is coupled to the supporting structure 14, as stated later. The buoy 16 may be of the type referred to as a "spar buoy" which is formed from an elongated cylindrical body and anchored by anchor means 18, such as anchor chains. At least a top portion of the buoy 16 can float on the water surface or within the body of water when it is disconnected from the vessel 16.

The buoy 16 carries underbuoy hoses or riser conduits 20 which can be connected with pipe lines (not shown) of offshore installations such as an oil well. The top end of the buoy 16 is provided with a universal joint which, for example, consists of a fork-shaped base member 22 secured to the buoy 16, a first cross-shaped link member 26 with arms 27 which cross-shaped link member is connected by means of a shaft 24 to the fork-shaped base member 22 to rotate about the shaft 24, and a second link member 28 which is rotatably mounted on the arms 27. The second link member 28 is provided with an opening 30 for receiving a shackle or hook member 34 attached to a lower end of a chain or cable 32. The chain or cable 32 can be moved up or down by means of a winch 36 which is arranged on the supporting structure 14 whereby the buoy 16 can be lifted up to a position at which the buoy 16 may be coupled to the supporting structure 14. While a preferred embodiments of the universal joint has been described, it is possible to use any other desired universal joint.

The link member 26 is provided with a rod or bar 38 each end of which is projected beyond the corresponding outer surface of the link member 26.

The supporting structure 14 consists of a cylindrical hollow casing 40 which is mounted on the outermost end of the outrigger 12 so as to rotate about a vertical axis with respect to the outrigger 12. The inner wall of the casing 40 is provided with a pair of projections 42 which are diametrically opposed. Each of the projections 42 is provided with a vertical or longitudinal groove 44 for guiding the outermost end of the rod 38.

When the buoy 16 is lifted up from the surface of a body of water to the supporting structure 14 on winding up the cable 32 by driving the winch 36, the end of the rod 38 will be inserted into the groove 44 and then the rod 38 will be guided along the groove 44 for engaging the buoy 16 with the supporting structure 14. Each projection 42 is provided with an opening 50 for guiding a block 48 with a recess 46 so as to slide it horizontal direction in the opening 50. The rod or bar 38 can be inserted into the recess 46 when the block 48 is urged to the link member 26.

The casing 40 is provided with a pair of hydraulic means 52. A piston rod 54 of each of the hydraulic means 52 is connected with the block 48. When each block 42 is moved to the rod 38 by means of the hydraulic means 52, the recess 46 in each of the block 42 can be engaged with the bar 38 so that the buoy 16 may be coupled with the supporting structure 40.

In taking consideration into account of mechanical trouble in the hydraulic means 52, it is possible to provide suitable means such as chain-block means (not shown) which can be controlled or moved by human power in order to move the block 48, if desired.

Figure 2:
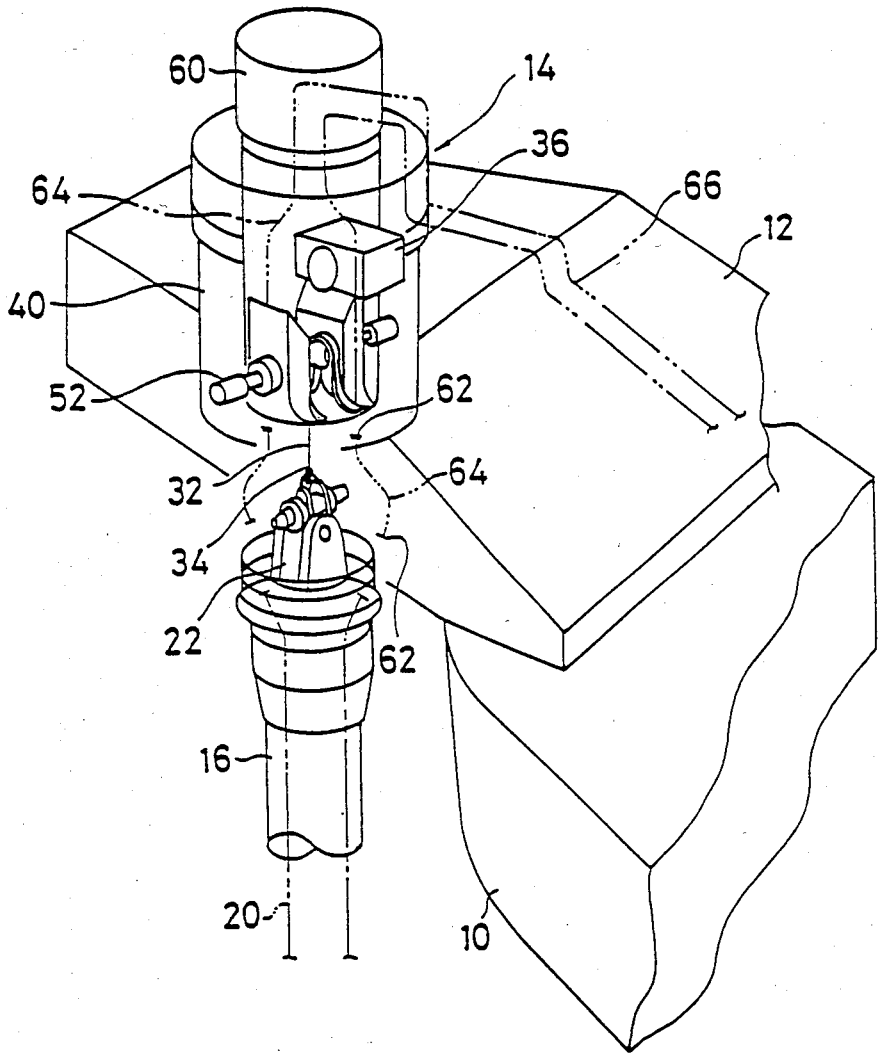
FIG. 2 shows schematically a perspective view of a supporting structure and a connecting portion of the buoy according to the present invention.
Figure 3:
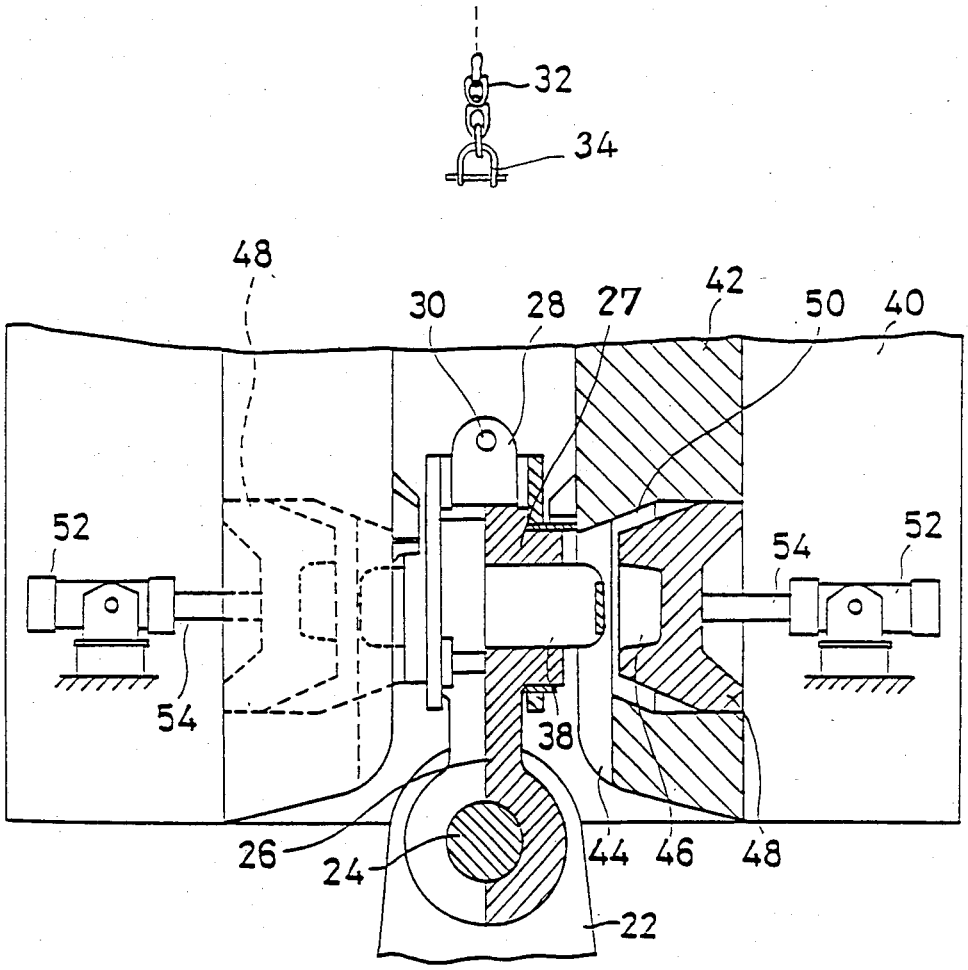
FIG. 3 is a half sectional view showing the supporting structure and link members of the buoy according to the present invention.

As shown in FIG. 2, the top of the support structure 14 is provided with a rotatable swivel 60 and the riser conduits 20 are connected with hoses 64 by means of couplings 62 so that fluid or oil from the riser conduits 20 may be transmitted to the tanker 10 through the swivel 60 and conduits 66.

In operation, after the tanker 10 has been approached to the buoy 16, the cable 32 is lowered down by driving the winch 36 to engage the hook 34 of the cable 32 with the opening 30 in the top 28 of the link member 26 of the buoy 16 on the surface of a body of water and then the cable 32 is lifted up together with the buoy 16. Thus, each end of the rod 38 can be inserted into and guided along the vertical groove 44 in each projection 42 of the casing 40. When the rod 38 has been aligned with the recess 46 in the block 48, the hydraulic means 52 is driven to forward the piston rod 54 from its retired position thereby the block 48 can be moved along the opening 50 in the projection 42 so as to receive the rod 38 into the recess 46 in the block 48.

Then the hose 64 can be coupled to the riser conduit 20, and the tanker 10 can be moored for operation.

If it is necessary to remove the tanker 10 from the buoy 16 in its mooring condition, the above mentioned operation will be reversed.

It is understood by those skilled in the art that the foregoing description is a preferred embodiment of the disclosed device and that various changes and modifications may be made in the invention without departing from the spirit and scope thereof.

What we claim is:

1. A mooring system for a buoyant structure having a storage capacity of an enormous quantity of fluid comprising an outrigger secured to one end of said structure, a buoy supporting structure mounted on said outrigger to rotate about a vertical axis, and a buoy anchored by means of chains, in which said buoy supporting structure is in the form of a hollow cylindrical member, a pair of diametrically opposed projecting members provided on the inner wall of said cylindrical member, each of said projecting members having a horizontal opening and a vertical groove therein, a block having a recess slidably mounted in each of said horizontal openings in said projecting member and, hydraulic means for driving said block, the top of said buoy is provided with a universal joint means having a first link member and a rod projecting beyond the side surfaces of said first link member, and means for lifting up said buoy to insert each end of said rod into said vertical grooves and to align said rod with said horizontal opening in each of said blocks.

2. A mooring system as claimed in claim 1 in which said universal joint means consists of a fork-shaped base member secured to the top of said buoy, said first link member being a cross shaped member with arms supported by a shaft on said fork-shaped base member and a second link member rotatably mounted on said arm of said first link member. members consist of a fork-shaped member secured to said buoy and a member pivotally connected to said fork-shaped member.

3. A mooring system as claimed in claim 1 in which said universal joint means is provided with an opening for engaging with a cable which is driven by means of said lifting means.

* * * * *